United States Patent [19]

Leonard

[11] 4,070,267

[45] Jan. 24, 1978

[54] COAL PROCESSING SYSTEM FOR REDUCING THE AMOUNT OF INSOLUBLE COAL PRODUCTS IN A LIGHT FRACTION STREAM

[75] Inventor: Robert E. Leonard, Oklahoma City, Okla.

[73] Assignee: Kerr-McGee Corporation, Oklahoma City, Oklahoma.

[21] Appl. No.: 691,576

[22] Filed: June 1, 1976

[51] Int. Cl.[2] ..... C10G 1/04

[52] U.S. Cl. ..... 208/8

[58] Field of Search ..... 208/8

[56] References Cited

U.S. PATENT DOCUMENTS

| | | | |
|---|---|---|---|
| 3,018,241 | 1/1962 | Gorin | 208/8 |
| 3,607,717 | 9/1971 | Roach | 208/8 |
| 3,791,956 | 2/1974 | Gorin et al. | 208/8 |
| 3,852,183 | 12/1974 | Snell | 208/8 |

*Primary Examiner*—Herbert Levine
*Assistant Examiner*—James W. Hellwege
*Attorney, Agent, or Firm*—William G. Addison

[57] ABSTRACT

An improved system for processing coal wherein a feed mixture (comprising a dissolving solvent, insoluble coal products and soluble coal products) is separated in a first separation zone, provided with a coalescing section, into a first heavy fraction and a first light fraction (comprising soluble coal products, the dissolving solvent and some insoluble coal products), and a portion of the insoluble coal products is separated from the first light fraction by contacting at least the first light fraction with the coalescing section. Such contacting reduces the amount of insoluble coal products in the first light fraction withdrawn from the first separation zone.

17 Claims, 6 Drawing Figures

COAL PROCESSING SYSTEM FOR REDUCING THE AMOUNT OF INSOLUBLE COAL PRODUCTS IN A LIGHT FRACTION STREAM

BACKGROUND OF THE INVENTION

1. Field of the Invention

The present invention relates generally to the liquefaction and fractionation of hydrocarbonaceous materials and, more particularly, but not by way of limitation, to an improved system for reducing the amount of insoluble coal products in a light fraction stream portion of a feed mixture.

2. Description of the Prior Art

Various coal processing systems have been developed in the past wherein coal has been treated with one or more solvents and processed to separate the resulting insoluble coal products from the soluble coal products, some systems including provisions for recovering and recycling the solvents.

U.S. Pat. Nos. 3,607,716 and 3,607,717, issued to Roach and assigned to the same assignee as the present invention, disclose processes wherein coal is contacted with a solvent and the resulting mixture then is separated into a heavy phase containing the insoluble coal products and a light phase containing the soluble coal products. In such processes, the light phase is withdrawn and passed to a downstream fractionating vessel wherein the soluble coal product is separated into multiple fractions. Other processes for separating the soluble coal products from the insoluble coal products utilizing one or more solvents are disclosed in U.S. Pat. Nos. 3,607,718 and 3,642,608, both issued to Roach et al., and assigned to the same assignee as the present invention.

DESCRIPTION OF THE PREFERRED EMBODIMENTS

Figure 1:
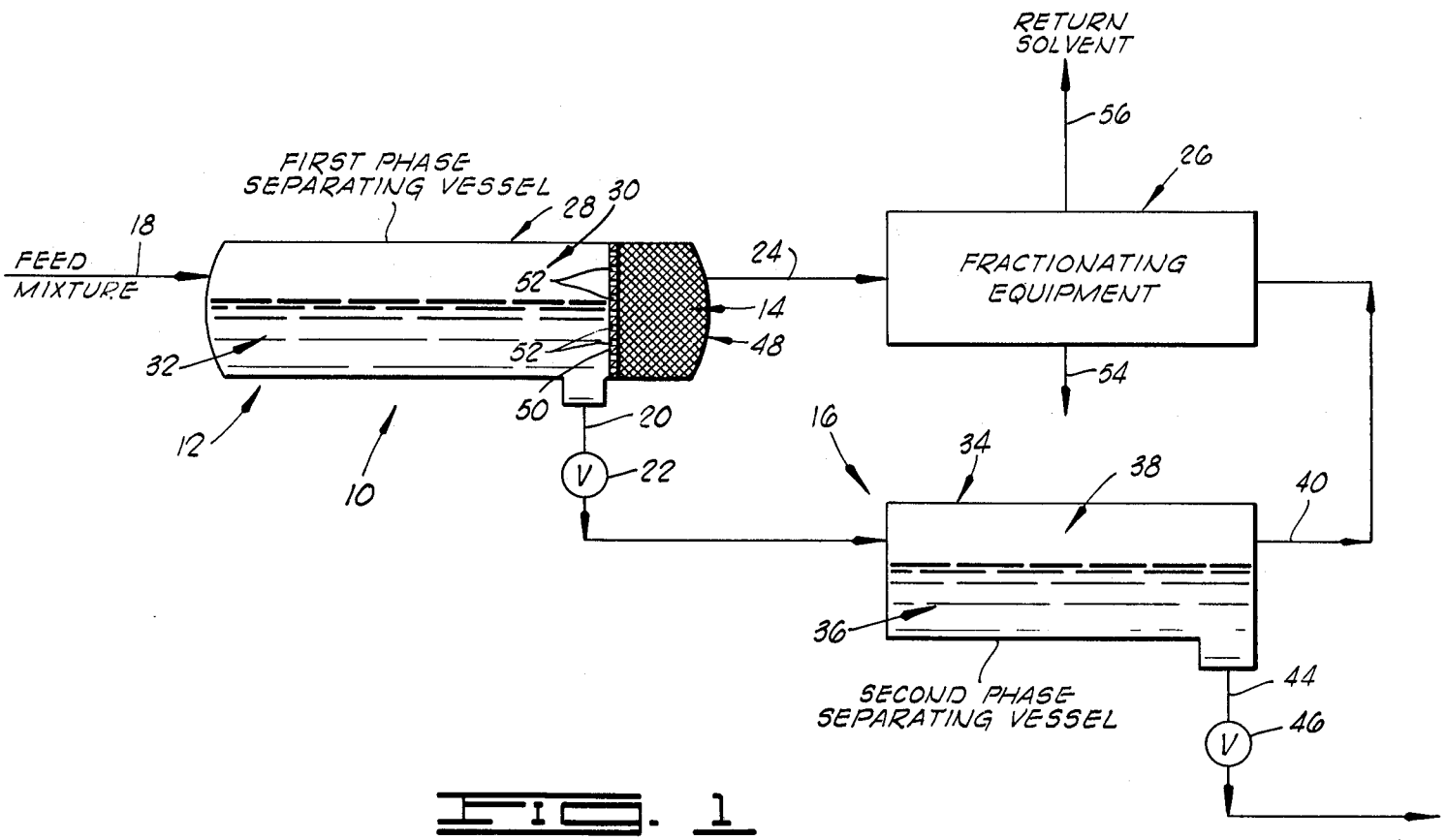
FIG. 1 is a schematic, diagrammatic view showing one system arranged in accordance with the present invention.

Referring to FIG. 1, general reference numeral 10 designates a coal processing system arranged in accordance with the present invention, which generally includes a first separation zone 12 provided with a coalescing section 14 and a second separation zone 16. In general, a feed mixture comprising soluble coal products, insoluble coal products and a dissolving solvent is passed through a conduit 18 and introduced into the first separation zone 12 wherein the feed mixture is separated into a first heavy fraction comprising substantially the insoluble coal products and a first light fraction comprising substantially the soluble coal products and the dissolving solvent. The first heavy fraction is withdrawn from the first separation zone 12 through a conduit 20 and passed through a pressure reducing valve 22 interposed in the conduit 20 to the second separation zone 16. The first light fraction is withdrawn from the first separation zone 12 through a conduit 24 and passed downstream to fractionating equipment (designated in the drawing by the general reference numeral 26).

It is desirable to pass the feed mixture into and through the first separation zone 12 at a relatively high rate of flow to increase the production of the soluble coal or, in other words, to increase the process production rate. However, when the rate of flow of the feed mixture into and through the first separation zone 12 is relatively high, the velocity of the feed mixture entering and leaving the first separation zone, the velocity of the first light fraction within the first separation zone, and the velocity of the first light fraction leaving the first separation zone are each relatively high. The relatively high velocity of the first light fraction in the first separation zone has been found to substantially reduce the separating efficiency or, in other words, to substantially increase the amount of the insoluble coal products in the first light fraction withdrawn from the first separation zone due to the tendency of the high velocity first light fraction to carry droplets of liquid containing particles of insoluble coal products from the first separation zone 12.

To reduce the amount of insoluble coal products in the first light fraction withdrawn from the first separation zone, it has been proposed to pass portions of the feed mixture into each one of several phase separating vessels located within the first separation zone, thereby lowering the volume of feed mixture processed through any one of the several phase separating vessels while maintaining the total volume of feed mixture processed through all of the phase separating vessels (the process production rate) within commercially or economically acceptable limits. Although the velocity of the first light fraction processed through the first separation zone is reduced by utilizing the several phase separating vessels, the initial capital investment and the subsequent operating and maintenance expenses are substantially increased.

Utilizing the system of the present invention, the feed mixture is processed through the first separation zone 12 at a relatively high rate of flow or, in other words, the velocities of the feed mixture and the first light fraction portion thereof are each relatively high and yet a substantial portion of the insoluble coal products are separated from the first light fraction before the first light fraction is withdrawn from the first separation zone 12 and passed downstream to the fractionating equipment 28. The term "first separation zone" 12, as used herein, includes a first phase separating vessel 28, the conduit 18 through which the feed mixture is passed to the first phase separating vessel 28, and the conduit 24 through which the first light fraction is passed from the first phase separating vessel 28 to the fractionating equipment 26. Thus, coalescing sections such as the coalescing section 14 can be located in the first separation zone 12, in the first phase separating vessel 28, or in one of the conduits 18 or 24, or in the first phase separating vessel 28 and in one or both of the conduits 18 and 24, or in both of the conduits 18 and 24 (the coalescing section 14, more particularly, being shown in FIG. 1 located within the first phase separating vessel 28). In any event, the coalescing section 14 is located in the first separation zone 12 such that at least the first light fraction is contacted with the coalescing section prior to the first light fraction being passed downstream to the fractionating equipment 26 to reduce the amount of insoluble coal products in the first light fraction withdrawn from the first separation zone 12 and passed downstream to the fractionating equipment 26.

In general, the feed mixture passed into the conduit 18 is produced by first solubilizing coal. Portions of this solubilized coal are mixed with a solvent. In one particular process, pulverized coal is contacted with a first dissolving solvent and liquefied to produce a mixture comprising the first dissolving solvent, the soluble coal products and the insoluble coal products. In this particular process, substantially all of the first dissolving solvent is removed from the soluble and the insoluble coal products, and then the soluble and the insoluble coal products are contacted with a second dissolving solvent, the resulting mixture comprising the soluble coal products, the insoluble coal products and the second dissolving solvent being the feed mixture passed into and through the conduit 18.

Although the particular process generally described above contemplates the utilization of two, different dissolving solvents, the present invention contemplates systems wherein the coal is contacted by a single dissolving solvent or systems wherein the coal is contacted by more than two dissolving solvents. Therefore, the feed mixture passing through the conduit 18 and introduced into the first separation zone 12 is referred to herein as including a "dissolving solvent", which may be the second dissolving solvent or the first dissolving solvent or a combination of the first and the second dissolving solvents or some other dissolving solvent or solvents utilized for producing the feed mixture comprising the insoluble coal products, the soluble coal products and the dissolving solvent.

In the particular process generally described above, the first dissolving solvent preferably is an organic solvent suitable for liquefying coal, and various such solvents suitable for liquefying coal are disclosed in U.S. Pat. Nos. 3,607,716, 3,607,717, 3,607,718 and 3,642,608, for example. The second dissolving solvent is of the type sometimes described as a "light organic solvent" in the just-mentioned U.S. patents and includes, for example, pyridine, benzene and hexane. Also, the details of particular processes for liquefying coal and subsequently separating the soluble coal products from the insoluble coal products are disclosed in the just-mentioned U.S. patents.

The term "insoluble coal products" as used herein refers to the undissolved coal, ash, other solid inorganic particulate matter and other such matter which is insoluble in the dissolving solvent. The term "soluble coal products" as used herein refers to the matter which is soluble in the dissolving solvent.

The first separation zone 12 includes the first phase separating vessel 28 and, in the vessel 28, the feed mixture is separated to form the first light fraction in an upper portion 30 of the vessel 28 and the first heavy fraction in a lower portion 32 of the vessel 28, the first heavy fraction being allowed to settle within the lower portion 32 while the first light phase rises to the upper portion 30. In one particular embodiment, the temperature level in the first phase separating vessel 28 is in a range of about 525° F to about 630° F, and the pressure level in the first phase separating vessel 28 is in the range of from about 700 p.s.i.g. to about 1000 p.s.i.g. In this particular embodiment, the feed mixture is passed into the conduit 18 at temperature and pressure levels generally within the ranges referred to above with respect to the temperature and pressure levels in the first phase separating vessel 28.

The first heavy fraction is withdrawn from the first phase separating vessel 28 and passed through the pressure reducing valve 22 wherein the first heavy fraction is flashed to a preselected pressure level less than the pressure level of the first heavy fraction in the first phase separating vessel 28. In the one particular embodiment referred to before, the pressure reducing valve 22 flashes the second heavy fraction to a reduced pressure level substantially equal to atmospheric pressure and a stream, which is essentially a two-phase system, passes from the valve 22 to the second separation zone 16. Although the pressure reduction of the first heavy fraction is shown in FIG. 1 as being accomplished across a single pressure reducing valve 22, it may be desirable in some applications to utilize several such pressure reducing valves for sequentially decreasing the pressure level of the first heavy fraction.

The second separation zone 16 includes a second phase separating vessel 34. The first heavy fraction is passed from the pressure reducing valve 22 through the conduit 20 and into the second phase separating vessel 34 wherein the first heavy fraction is allowed to separate within the second phase separating vessel 34 to form a fluid-like second heavy fraction which accumulates in a lower portion 36 of the second phase separating vessel 34, and a second light fraction which rises to an upper portion 38. The second light fraction is essentially dissolving solvent vapor, and this second light fraction is withdrawn from the second phase separating vessel 34 through a conduit 40. The second light fraction does include some soluble coal products which were not removed via the phase separation within the second phase separating vessel 34. Thus, in a preferred embodiment as shown in FIG. 1, the second light fraction is passed through the conduit 40 to the fractionating equipment 26.

The second heavy fraction is withdrawn from the second phase separating vessel 34 through a conduit 44 at a rate controlled by a level control valve 46 interposed in the conduit 44 and is passed to downstream apparatus (not shown). The second heavy fraction withdrawn from the second phase separating vessel 34 comprises substantially all of the suspended particles of insoluble coal products contained in the feed mixture initially fed to the first phase separating vessel 28 via the conduit 18.

Referring again to the first phase separating vessel 28, the coalescing section 14, more particularly, is disposed in one end portion 48 of the first phase separating vessel 28 and positioned so the overhead first light fraction passes through the coalescing section 14 as the first light fraction is withdrawn from the first phase separating vessel 28. When ash-containing distillation residues derived from coal liquefaction processes are treated with benzene, or other such suitable dissolving solvents, at an elevated temperature and at an elevated pressure, ash or other such insoluble coal products are entrained in numerous liquid droplets, resulting in an undesirable carry-over of such insoluble coal products in the first light fraction withdrawn from the first separation zone 12. As mentioned before, it is desirable to operate the coal processing system 10 at relatively high production rates, which results in a relatively high fluid velocity of the first light fraction in the first separation zone 12. When the fluid velocity of the first light fraction is relatively high, there is an increased tendency for the smaller droplets of ash-containing liquids to be carried over from the first separation zone 12 to the fractionating equipment 26. In other words, the smaller droplets of liquids containing entrained insoluble matter have a tendency to be removed with the first light fraction as the first light fraction is withdrawn from the first phase separating vessel 28. In addition to the insoluble coal products entrained in the small liquid droplets, the relatively high velocity of the first light fraction results in some particles of insoluble coal products which are not entrained in liquid droplets to be carried out of the first separation zone 12 in the first light fraction. The coalescing section 14 in the first phase separating vessel 28 is positioned to contact the first light fraction and to substantially reduce the carry-over of insoluble matter, while permitting the first light fraction to be moved through and discharged from the first separation zone 12 at a relatively high velocity.

A plate 50 is supported in the first phase separating vessel 28 and the plate 50 is positioned generally adjacent the coalescing section 14. A plurality of holes 52 (only some of the holes 52 being shown in FIG. 1) are formed through the plate 50. The first light fraction passes through the holes 52 in the plate 50 into contact with the coalescing section 14, the first light fraction contacting the coalescing section 14 and subsequently being withdrawn from the first phase separating vessel 28. The coalescing section 14 is of a conventional design and, in operation, the coalescing section 14 provides a relatively large surface area for the coalescing of the relatively small liquid droplets into larger liquid droplets which then settle into the lower portion 32 of the first phase separating vessel 28. Thus, for any particular velocity of the first light fraction, a reduced amount of liquid droplets containing insoluble matter are carried from the first phase separating vessel 28 to the fractionating equipment 26. In other words, the disposition of the coalescing section 14 in the first separation zone 12 for contacting at least the first light fraction allows the feed mixture to be moved into the first phase separating vessel 28 and the first light fraction to be withdrawn from the first phase separating vessel 28 at relatively higher velocities while still reducing the amount of insoluble matter in the first light fraction withdrawn from the first separation zone 12.

The first light fraction, which rises to the upper portion 30 of the first phase separating vessel 28, is a solvent-rich fraction comprising substantially the soluble coal products and the dissolving solvent. The first light fraction is passed through the conduit 24 to the fractionating equipment 26 and the second light fraction is passed through the conduit 40 to the fractionating equipment 26. In one embodiment, the fractionating equipment 26 is designed to separate the first and the second light fractions into one or more coal liquefaction fractions (soluble coal products) which are discharged through a conduit 54 (the conduit 54 being two or more separate conduits in those systems where the soluble coal products are separated into more than one fraction with each individual fraction passing through one of the several conduits represented by the conduit 54 diagrammatically shown in FIG. 1).

The dissolving solvent passed to the fractionating equipment 26 via the conduits 24 and 40 is separated from the soluble coal products. The separated dissolving solvent is passed from the fractionating equipment 26 through a conduit 56 and may be returned to the system for use in providing the feed mixture in a manner generally described before, as indicated via the designation "RETURN SOLVENT" in FIG. 1.

EMBODIMENT OF FIG. 2

Figure 2:
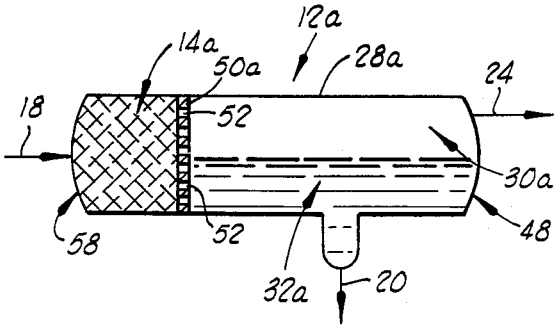
FIG. 2 is a view of a modified first separation zone similar to the first separation zone shown in FIG. 1.

Shown in FIG. 2 is a modified first separation zone **12*a* which is arranged similar to the first separation zone 12 (shown in FIG. 1), the salient difference being that the coalescing section 14*a* is disposed in an end portion 58 of the first phase separating vessel 28*a*, opposite the end portion 48. The coalescing section 14*a* is supported in the first phase separating vessel 28 via the perforated plate 50*a* in a manner similar to that described before with respect to the coalescing section 14 and the plate 50 (shown in FIG. 1**).

The operation of the coal processing system 10 of the present invention incorporating the modified first separation zone **12*a* will be substantially the same as the operation of the coal processing system 10 incorporating the first separation zone 12 (shown in FIG. 1 and described before). The feed mixture is passed into the first phase separating vessel 28*a* via the conduit 18; at least the first light fraction is contacted via the coalescing section 14*a*; the first light fraction is withdrawn from the first phase separating vessel 28*a* via the conduit 24; and the first heavy fraction is withdrawn from the first phase separating vessel 28*a* via the conduit 20. The contacting of at least the first light fraction via the coalescing section 14*a* substantially reduces the amount of the insoluble coal products and other insoluble matter in the first light fraction withdrawn from the first separation zone 12*a*** in a manner and for reasons described before.

EMBODIMENT OF FIG. 3

Figure 3:
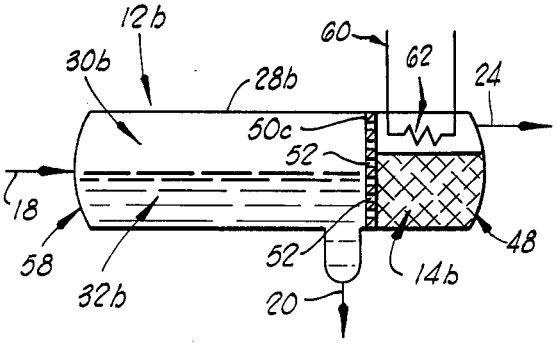
FIG. 3 is a view similar to FIG. 2, but showing another modified first separation zone.

Shown in FIG. 3 is another modified first separation zone **12*b* which is arranged similar to the first separation zone 12 (shown in FIG. 1), the salient difference being that a modified coalescing section 14*b* is supported in the end portion 48 of the first phase separating vessel 28*b* and a heater 60 having a heating coil 62 is disposed within the upper portion 30*b* of the first phase separating vessel 28*b*. The heater 60 is positioned near the coalescing section 14*b* to heat a portion of the first light fraction prior to withdrawing the first light fraction from the first phase separating vessel 28*b***.

When the temperature level of a portion of the first light fraction is elevated to a higher temperature level, the heated portion of the first light fraction becomes supersaturated, which results in the generation of liquid reflux since the solubility of the soluble coal products in the dissolving solvent is an inverse function of the temperature level. Thus, the heating of the first light fraction by the heater 60 causes a liquid reflux to be generated which wets the coalescing section **14*b*. The wetting of the coalescing section 14*b* by the liquid reflux causes the first light fraction to be passed through and contacted by the reflux wetted coalescing section 14*b* which facilitates the operation of the coalescing section 14*b* by further reducing the insoluble matter in the first light fraction withdrawn from the first separation zone 12*b***.

The operation of the coal processing system 10 of the present invention incorporating the modified first separation zone **12*b* will be substantially the same as the operation of the coal processing system 10 incorporating the first separation zone 12 (shown in FIG. 1 and described before), except a portion of the first light fraction is heated prior to withdrawing the first light fraction from the first phase separating vessel 28b, thereby generating liquid reflux for wetting the coalescing section 14b. The coalescing section 14b provides a relatively large surface which is wetted by the reflux and fine insoluble particles which have not been entrained in liquid droplets impinge the relatively large wetted surface of the coalescing section 14b and such particles are entrained in liquid droplets formed via the reflux. The insoluble particles entrained in the reflux droplets fall to the lower portion 32b of the first phase separating vessel 28b and thus the insoluble matter in the first light fraction is reduced further by the reflux generating heater 60 operating in cooperation with the coalescing section 14b. The liquid reflux also washes the insoluble coal products from the coalescing section 14b in addition to wetting the coalescing section 14b** for providing a relatively large wetted surface for impingement of any solid insoluble coal products or relatively small liquid droplets entrained with insoluble coal products.

EMBODIMENT OF FIG. 4

Figure 4:
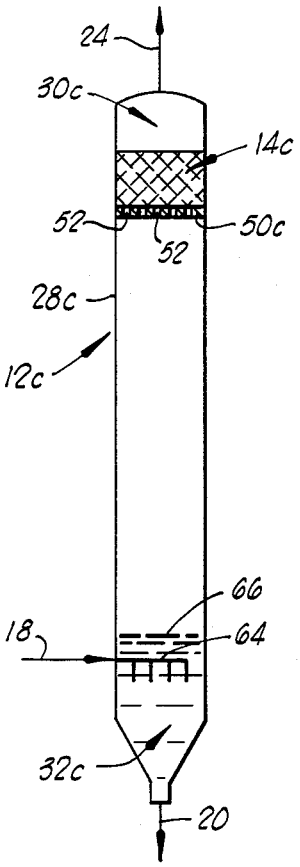
FIG. 4 is a view similar to FIG. 2, but showing still another modified first separation zone.

Shown in FIG. 4 is another modified first separation zone 12c, which includes a coalescing section 14c supported in the upper portions 30c of the modified first phase separating vessel 28c by the perforated plate 50c, the modified first phase separating vessel 28c being of the type generally referred to in the art as a "vertical" vessel as compared to the "horizontal" type of vessels diagrammatically depicted in FIGS. 1 through 3. A distributing header 64 is disposed in the first phase separating vessel 28c and connected to the conduit 18.

During the operation of the embodiment shown in FIG. 4, the feed mixture is separated in the first phase separating vessel 28c into the first heavy fraction and the first light fraction. The first heavy fraction is allowed to settle within the lower portion 32c of the first phase separating vessel 28c and the first light fraction is moved or rises through an upper portion 30c of the first phase separating vessel 28c. A predetermined volume of the first heavy fraction is accumulated and maintained within the lower portion 32c thereby forming a first heavy fraction surface level 66 within the first phase separating vessel 28c. The distributing header 64, more particularly, is disposed within the first heavy fraction accumulated within the lower portion 32c and below the first heavy fraction surface level 66.

The feed mixture is passed from the conduit 18 into and through the distributing header 64 and since the distributing header 64 is disposed below the first heavy fraction surface level 66, the feed mixture is dispersed within the accumulated portion of the first heavy fraction as the feed mixture is passed into the first phase separating vessel 28c through the distributing header 64. The distributing header 64 has a plurality of openings spaced about the lower portion 32c, as diagrammatically shown in FIG. 4, and the distributing header 64 is constructed and shaped such that the distributing header 64 openings are spaced within the lower portion 32c to substantially assure that the feed mixture is dispersed throughout the accumulated portion of the first heavy fraction.

The first light fraction rises through the upper portion of the first phase separating vessel 28c, though the holes 52 in the plate 50c and through the coalescing section 14c, the first light fraction being withdrawn from the first phase separating vessel 28c via the conduit 24. Thus, the first light fraction is intimately contacted with the coalescing section 14c within the first separation zone 12c in a manner and for reasons similar to that described before with respect to FIGS. 1, 2 and 3.

EMBODIMENT OF FIG. 5

Figure 5:
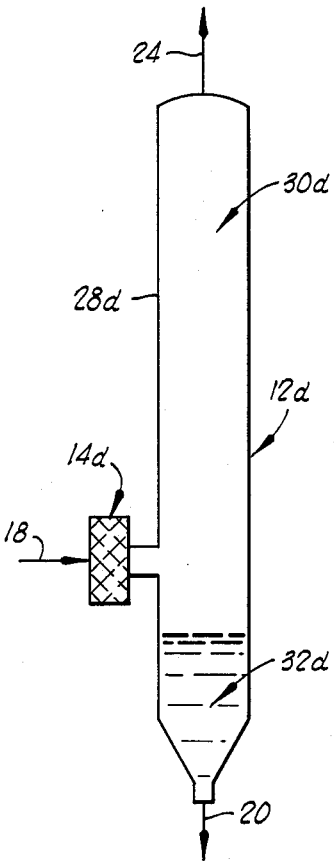
FIG. 5 is a view similar to FIG. 2, but showing one other modified first separation zone.

Shown in FIG. 5 is another modified first separation zone 12d and a modified coalescing section 14d, the coalescing section 14d being interposed in the conduit 18. Thus, the coalescing section 14d is disposed in the first separation zone 12d such that the feed mixture is passed through the coalescing section 14d prior to being passed into the first phase separating vessel 28d or, in other words, before the feed mixture is separated into the first light fraction and the first heavy fraction within the first phase separating zone 12d.

EMBODIMENT OF FIG. 6

Figure 6:
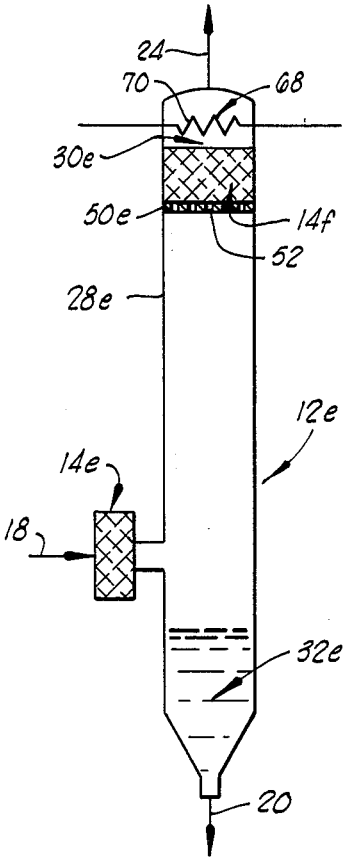
FIG. 6 is a view similar to FIG. 2, but showing yet another modified first separation zone.

Shown in FIG. 6 is another modified first separation zone 12e which includes a first phase separating vessel 28e. A coalescing section 14e is interposed in the conduit 18 in a manner and for reasons like that described before with respect to the coalescing section 14d (FIG. 5), and another coalescing section 14f is supported within the upper portion 30e of the first phase separating vessel 28e via a plate 50e in a manner and for reasons like that described before with respect to the coalescing section 14c (FIG. 4).

A heater 68 having a heating coil 70 is disposed and supported within the upper portion 30e of the first phase separating vessel 28e. The heater 68 is positioned with respect to the coalescing section 14f such that the first light fraction passes through the coalescing section 14f and then the first light fraction passes about the heater 60, the heater 60 heating a portion of the first light fraction and subsequently the first light fraction being withdrawn from the first phase separating vessel 28e through the conduit 24. The heater 68 heats a portion of the first light fraction to an elevated temperature level such that the heated portion of the first light fraction becomes super-saturated which results in the generation of liquid reflux in a manner and for reasons described before in connection with the heater 60 shown in FIG. 3. Thus, the liquid reflux wets the coalescing section 14f for increasing the operational efficiency of the coalescing section 14f by further reducing the insoluble matter in the first light fraction withdrawn from the first separation zone 12e.

For the purpose of illustrating the present invention, feed mixtures are prepared by mixing soluble coal (together with its associated insoluble material) with a dissolving solvent (comprising benzene) in a ratio of about one part by weight of coal to about five parts by weight of benzene at a pressure level in the range of from about 700 p.s.i.g. to about 1000 p.s.i.g. and at a temperature level in the range of from about 525° F to about 630° F. The soluble coal portion of the feed mixture so prepared was analyzed and found to have the analyses set forth in Table I below.

TABLE I

| | |
|---|---|
| Specific Gravity 60/60: | 1.34 |
| Proximate Analyses | |
| % Loss at 105° C | 0.4 |
| % Volatile Matter | 44.7 |
| % Fixed Carbon | 41.5 |
| % Ash | 13.4 |
| Ultimate Analyses | |
| % Carbon | 72.7 |
| % Hydrogen | 5.7 |
| % Nitrogen | 1.6 |

TABLE I-continued

| | |
|---|---|
| % Sulfur | 2.01 |
| % Oxygen (diff.) | 4.59 |
| Sulfur Distribution: | |
| $SO_4$ | <0.1 |
| Pyrite | <0.1 |
| Pyrrhotite | 1.82 |
| Organic | 0.19 |

The prepared feed mixtures then are utilized in various test runs to demonstrate the effectiveness of the present invention. In each of these test runs, the temperature level in the first phase separating vessel 28 is about 630° F and the pressure level is about 800 p.s.i.g.

The results of such test runs is described in greater detail in the following Examples. More particularly, Examples I, II and III below, relate to the placement of the coalescing section at different locations within the first separation zone 12 and Examples IV, V and VI illustrate the effect of increasing the velocity of the first light fraction within the first phase separating vessel in accordance with the present invention.

EXAMPLE I

Two runs are set forth to illustrate the present invention. Specifically, one run is made without a coalescing section in the apparatus. In the second run, a coalescing section 14 is disposed in the first phase separating vessel 28 (FIG. 1).

In each instance, portions of the first light fraction are withdrawn periodically through the conduit 24 and then are treated to recover the soluble coal products therefrom. It is determined that soluble coal products obtained from the first run, without the coalescing section, contain from about 0.09 percent to about 0.15 percent by weight of insoluble coal products. By way of contrast, the soluble coal products recovered from the run in which the coalescing section is present contain a lower percentage by weight of insoluble coal products.

EXAMPLE II

Two runs are conducted: one run is made without a coalescing section in the apparatus; and in the second run, a coalescing section **14*a* is disposed in the first phase separating vessel 28*a* (FIG. 2**).

In each instance, portions of the first light fraction are withdrawn periodically through the conduit 24 and then are treated to recover the soluble coal products therefrom. It is determined that soluble coal products obtained from the first run, without the coalescing section, contain from about 0.09 percent to about 0.15 percent by weight of insoluble coal products. By way of contrast, the soluble coal products recovered from the run in which the coalescing section is present contain a lower percentage by weight of insoluble coal products.

EXAMPLE III

Two runs are conducted: one run is made without a coalescing section in the apparatus; and in the second run a coalescing section **14*b* is disposed in the first phase separating vessel 28*c* (FIG. 3**).

In each instance, portions of the first light fraction are withdrawn periodically through the conduit 24 and then are treated to recover the soluble coal products therefrom. It is determined that soluble coal products obtained from the first run, without the coalescing section, contain from about 0.09 percent to about 0.15 percent by weight of insoluble coal products. By way of contrast, the soluble coal products recovered from the run in which the coalescing section is present contain a lower percentage by weight of insoluble coal products.

EXAMPLE IV

The feed mixture is passed through a first phase separating vessel having a distributing header like the first phase separating vessel **28*c* (FIG. 4) having the distributing header 64 and the coalescing section 14*c*. The velocity of the first light phase within the upper portion 30*c* is about 120 feet per hour. Portions of the first light fraction are withdrawn periodically through the conduit 24** and treated to recover the soluble coal products therefrom. It is determined that the soluble coal products obtained from the first light phase contain about 0.05 percent by weight insoluble coal products.

The coalescing section **14*c* then is removed from the first phase separating vessel 28*c* and the feed mixture is passed through the first separating vessel 28*c*, the velocity of the first light fraction within the upper portion 30*c* being about 120 feet per hour. Portions of the first light fraction are withdrawn periodically through the conduit 24** and treated to recover the soluble coal products therefrom. It is determined that soluble coal products obtained from the first light fraction contain about 0.09 percent by weight of insoluble coal products.

In a commercial coal processing system about nine first phase separating vessels **28*c*, each vessel 28*c*having an internal diameter of about twelve feet, would be required to process about 10,000 tons of feed mixture if the velocity of the first light fraction within the upper portion 30*c*** was about 120 feet per hour.

EXAMPLE V

The feed mixture is passed through a first phase separating vessel where a coalescing section is interposed in the conduit for contacting the feed mixture prior to the feed mixture being passed into the first phase separating vessel such as the first phase separating vessel **28*d* (FIG. 5) with the coalescing section 14*d* interposed in the conduit 18. The velocity of the first light fraction within the upper portion 30*d* is about 120 feet per hour. Portions of the first light fraction are withdrawn periodically through the conduit 24** and treated to recover the soluble coal products therefrom. It is determined that the soluble coal products obtained from the first light fraction contain about 0.06 percent by weight of insoluble coal products.

The coalescing section **14*d* then is removed from the conduit 18 and the feed mixture is passed through the first phase separating vessel 28*d* at a rate such that the velocity of the first light fraction within the upper portion 30*d* is about 120 feet per hour. Portions of the first light fraction are withdrawn periodically through the conduit 24** and treated to recover the soluble coal products therefrom. It is determined that the soluble coal products obtained from the first light fraction contain about 0.15 percent by weight of insoluble coal products.

EXAMPLE VI

The feed mixture is passed through a first phase separating vessel with a coalescing section in the inlet conduit, another coalescing section in the upper portion of the first phase separating vessel and a heater disposed near the second-mentioned coalescing section, such as the first phase separating vessel **28*e* with the coalescing section 14*e*, the second coalescing section 14*f* and the heater 68 (FIG. 6). The heating medium is passed through the heating coil 70 at a rate and at a temperature level sufficient to elevate the liquid temperature level of the first fraction near the heater 68 about 20° F. The velocity of the first light fraction within the upper portion 30***e* is about 230 feet per hour. Portions of the first light fraction are withdrawn periodically through the conduit 24 and treated to recover the soluble coal products therefrom. It is determined that the soluble coal products obtained from the first light fraction contain about 0.05 percent by weight of insoluble coal products.

In a commercial coal processing system, about five first phase separating vessels 28*c*, each vessel 28*c* having an internal diameter of about twelve feet, would be required to process about 10,000 tons of feed mixture if the velocity of the first light fraction within the upper portion 30*c* was about 230 feet per hour. Thus, a significant savings with respect to capital expenditures and operating costs is realized by raising the velocity from the 120 feet per hour mentioned before in connection with "Example IV" and the 230 feet per hour described above with respect to this "Example VI."

The present invention provides an improved first separation zone in a process for removing insoluble coal products from a feed mixture (comprising insoluble and soluble coal products and a dissolving solvent), and it should be noted that various physical vessel configurations may be utilized as the first phase separating vessel, such as the vessel configurations generally referred to as "horizontal" vessels shown in FIG. 1, 2 and 3, and the vessel configurations generally referred to as "vertical" vessels shown in FIGS. 4, 5 and 6, for example. The present invention is not limited to the utilization of any particular vessel configuration.

It should be noted that the heavy fraction or at least some portion of the heavy fraction also is contacted by the coalescing section in some of the embodiments described herein. Therefore, in describing the present invention, the phrase "at least the first light fraction" has been utilized sometimes herein in connection with the coalescing section to encompass both situations or embodiments (one, where it is primarily the first light fraction which is contacted with the coalescing section and the other, where the first light and heavy fractions each are contacted with the coalescing section).

Also, it should be noted that the present invention contemplates a coalescing section located in the conduit 24 of the embodiments shown in FIGS. 1 through 6 for contacting the first light fraction after withdrawing the first light fraction from the first phase separating vessel in addition to the various coalescing section locations specifically shown in the drawings.

Changes may be made in the process apparatus or in the steps of the process or in the sequence of the steps of the process of the present invention without departing from the spirit and scope of the invention as defined in the following claims.

What is claimed is:

1. A process for reducing the amount of insoluble coal products in a light fraction stream portion of a feed mixture comprising:

providing a feed mixture comprising a dissolving solvent, insoluble coal products and soluble coal products;

introducing the feed mixture into a first separation zone provided with a coalescing section;

maintaining the temperature level in the first separation zone in a range of from about 525° F. to about 630° F.;

maintaining the pressure level in the first separation zone in a range of from about 700 psig to about 1000 psig;

separating the feed mixture in the first separation zone into a first heavy fraction comprising the insoluble coal products and a first light fraction comprising the soluble coal products, the dissolving solvent and some insoluble coal products entrained in small liquid droplets;

contacting at least the first light fraction in the first separtion zone with the coalescing section to coalesce the small liquid droplets containing entrained insoluble coal products present in the first light fraction into larger liquid droplets which separate from the first light fraction in the first separation zone for reducing the amount of insoluble coal products in the first light fraction to be withdrawn from the first separation zone;

withdrawing the first light fraction from the first separation zone; and withdrawing the first heavy fraction from the first separation zone.

2. The process of claim 1 wherein the step of introducing the feed mixture into the first separation zone is defined further to include the step of;

introducing the feed mixture into a first phase separating vessel; and wherein the step of separating the feed mixture in the first separation zone is defined further as separating the feed mixture in the first phase separating vessel into the first heavy fraction and the first light fraction.

3. The process of claim 2 wherein the step of separating the feed mixture in the first phase separating vessel is defined further to include the steps of:

maintaining an amount of the first heavy fraction accumulated in one portion of the first phase separating vessel; and wherein the step of introducing the feed mixture into the first phase separating vessel is defined further to include the step of:

introducing the feed mixture into the first heavy fraction accumulated in the first phase separating vessel; and dispersing the feed mixture within the first heavy fraction accumulated in the first phase separating vessel.

4. The process of claim 2 further comprising:

contacting the feed mixture with a coalescing section prior to introducing the feed mixture into the first phase separating vessel.

5. The process of claim 4 wherein the step of contacting the first light fraction with the coalescing section is defined further to include the step of:

contacting the first light fraction with another coalescing section in the first phase separating vessel.

6. The process of claim 2 wherein the step of contacting the first light fraction with the coalescing section is defined further as contacting the first light fraction with the coalescing section in the first phase separating vessel.

7. The process of claim 2 defined further to include the step of:

withdrawing the first light fraction from the first phase separating vessel; and wherein the step of contacting the first light fraction with the coalescing section is defined further to include the step of:

contacting first light fraction with the coalescing section after withdrawing the first light fraction from the first phase separating vessel.

8. The process of claim 7 further comprising contacting the feed mixture with another coalescing section prior to introducing the feed mixture into the first phase separating vessel.

9. The process of claim 8 wherein the step of contacting the first light fraction with the coalescing section is defined further to include the step of:

contacting the first light fraction with still another coalescing section in the first phase separating vessel.

10. The process of claim 7 wherein the step of contacting the first light fraction with the coalescing section is defined further to include the step of:

contacting the first light fraction with another coalescing section before being withdrawn from the first phase separating vessel.

11. The process of claim 1 wherein the step of contacting the first light fraction with the coalescing section is defined further to include the step of:

contacting the feed mixture with the coalescing section before separating the feed mixture into the first light fraction and the first heavy fraction.

12. The process of claim 11 wherein the step of contacting the first light fraction with the coalescing section is defined further to include the step of:

contacting the first light fraction with another coalescing section after separating the feed mixture into the first light fraction and the first heavy fraction.

13. The process of claim 1 wherein the step of contacting the first light fraction with the coalescing section is defined further to include the step of:

contacting the first light fraction with the coalescing section after separating the feed mixture into the first light fraction and the first heavy fraction.

14. The process of claim 1 wherein the step of contacting the first light fraction with the coalescing section is defined further to include the step of:

contacting the first light fraction with the coalescing section before withdrawing the first light fraction from the first separation zone.

15. The process of claim 14 further comprising contacting the feed mixture with another coalescing section before separating the feed mixture into the first light fraction and the first heavy fraction.

16. The process of claim 1 defined further to include the steps of:

producing liquid reflux; and wetting the coalescing section with the liquid reflux.

17. The process of claim 16 wherein the step of producing the liquid reflux is defined further to include the step of:

heating the first light fraction in the first separation zone to generate the liquid reflux.

* * * * *